US010746147B2

(12) United States Patent
Göcmen et al.

(10) Patent No.: US 10,746,147 B2
(45) Date of Patent: Aug. 18, 2020

(54) HIGH-PRESSURE LINE

(71) Applicant: PETER FUCHS TECHNOLOGY GROUP AG, Stansstad (CH)

(72) Inventors: Alkan Göcmen, Birmenstorf (CH); Peter Fuchs, Freienbach (CH)

(73) Assignee: PETER FUCHS TECHNOLOGY GROUP AG, Stansstad (CH)

( * ) Notice: Subject to any disclaimer, the term of this patent is extended or adjusted under 35 U.S.C. 154(b) by 0 days.

(21) Appl. No.: 16/300,251

(22) PCT Filed: May 9, 2017

(86) PCT No.: PCT/CH2017/000042
§ 371 (c)(1),
(2) Date: Nov. 9, 2018

(87) PCT Pub. No.: WO2017/193224
PCT Pub. Date: Nov. 16, 2017

(65) Prior Publication Data

US 2019/0145363 A1 May 16, 2019

(30) Foreign Application Priority Data

May 11, 2016 (CH) ..... 615/16

(51) Int. Cl.
*F02M 55/02* (2006.01)
*F02M 55/04* (2006.01)
(Continued)

(52) U.S. Cl.
CPC ..... *F02M 55/025* (2013.01); *B21C 37/16* (2013.01); *B21J 7/16* (2013.01); *F02M 55/02* (2013.01);
(Continued)

(58) Field of Classification Search
CPC ..... F02M 55/02; F02M 55/025; F02M 2200/315; F02M 2200/8053;
(Continued)

(56) References Cited

U.S. PATENT DOCUMENTS 4,149,568 A * 4/1979 Kuntz ..... F02M 55/00 138/114
2010/0244440 A1* 9/2010 Badarinarayan ... F02M 37/0017 285/261
(Continued)

FOREIGN PATENT DOCUMENTS

DE 101 40 058 A1 10/2002
DE 10 2004 016 508 A1 10/2005
(Continued)

OTHER PUBLICATIONS

International Search Report for International Application No. PCT/CH2017/000042 dated Aug. 25, 2017.
(Continued)

*Primary Examiner* — Thomas N Moulis
(74) *Attorney, Agent, or Firm* — McCormick, Paulding & Huber PLLC

(57) ABSTRACT

The invention relates to a high-pressure line for conveying a fluid under high pressure to a consumer, in particular for supplying fuel under injection pressure to one or more injectors (14) of a combustion engine. It comprises a first (1), a second (2), and a third line section (3), which line sections (1, 2, 3) are flowed through successively in the intended operation of the high-pressure line and are jointly formed by a ones-piece component (4) made of metal, wherein the first line section (1) and the third line section (3) each have a smaller flow cross-section than the second line section (2) arranged between them.

41 Claims, 11 Drawing Sheets

(51) Int. Cl.
*B21C 37/16* (2006.01)
*B21J 7/16* (2006.01)

(52) U.S. Cl.
CPC ..... *F02M 55/04* (2013.01); *F02M 2200/315* (2013.01); *F02M 2200/8053* (2013.01); *F02M 2200/9046* (2013.01); *F02M 2200/9053* (2013.01)

(58) Field of Classification Search
CPC ... F02M 2200/9046; F02M 2200/9053; F02M 55/04; B21C 37/16
See application file for complete search history.

(56) References Cited

U.S. PATENT DOCUMENTS

2011/0214643 A1* 9/2011 Blizard ..... F02M 53/02 123/468
2012/0210980 A1* 8/2012 Bedekar ..... F02M 55/004 123/456
2014/0299207 A1* 10/2014 Pirkl ..... F02M 55/02 137/565.11
2015/0285297 A1* 10/2015 Khanfar ..... F16C 3/023 228/114
2015/0369185 A1* 12/2015 Takahata ..... F16L 19/0243 123/468
2017/0101971 A1* 4/2017 Serra ..... F02M 55/025
2017/0234282 A1* 8/2017 Wang ..... F02M 55/025 123/294
2017/0276108 A1* 9/2017 Takase ..... F02M 63/0285
2018/0100476 A1* 4/2018 Brown ..... F02M 63/005
2018/0223780 A1* 8/2018 Wickstone ..... F02M 63/029
2018/0238288 A1* 8/2018 Guerrassi ..... F02M 55/025
2019/0242348 A1* 8/2019 Hirabayashi ..... F02M 55/025

FOREIGN PATENT DOCUMENTS

DE 10 2014 014 818 A1 11/2015
EP 1398496 A2 3/2004
EP 2 728 160 A1 5/2014
JP 2001-20828 A 1/2001
JP 2004036542 A 2/2004
WO 2004069446 A1 8/2004
WO 2005038232 A1 4/2005
WO 2013/117311 A1 8/2013
WO 2015129617 A1 3/2017

OTHER PUBLICATIONS

Swiss Search Report for Application CH00615/16 with Abbreviated English Translation.

* cited by examiner

HIGH-PRESSURE LINE

CROSS-REFERENCE TO RELATED APPLICATIONS

This application is a National Stage application of International Patent Application No. PCT/CH2017/000042 filed May 9, 2017, which claims priority to Swiss Patent Application No. 615/16, filed May 11, 2016, each of which is hereby incorporated by reference in its entirety.

TECHNICAL FIELD

The present invention relates to a high-pressure line for the conveying of a fluid under high pressure to a consumer, a method for manufacturing such a high-pressure line, as well as a combustion engine, in particular a diesel or gas engine, with such a high-pressure line as fuel line in accordance with the preambles of the independent patent claims.

BACKGROUND

In order to be able to meet the ever stricter regulations regarding the emissions, modern diesel engines comprise so-called common rail injection systems. This means a high-pressure injection system consisting of a high-pressure pump, a high-pressure store, and connecting lines, the injectors, and an electronic control unit for the control and monitoring of the injection. This is why it is usually referred to as an electronic diesel injection. The superficial benefit of the common rail injection is the reduced emission of soot. This is achieved by the finest atomization of the diesel during injection. The prerequisite for this is that both the injection pressure as well as the injection rate are constant during injection. These properties are considerably supported by a constant pressure in the store, which in turn is supported by a sufficiently large volume in the store.

For the realization of the storage function in a common rail system, there are basically two different variants known:

(1) formation of individual stores in the single injectors or in storage tanks attached to the injectors, respectively, or (2) realisation of the store in the form of a collection line with a relatively large line diameter, from which individual supply lines each branch off to the injectors.

The first variant has the advantage that each injector has its own store for itself, from which it is supplied, so that the individual injectors do not have much influence on each other. However, this variant has the disadvantage that it requires a relatively large amount of installation space in the region of the cylinder head and that it requires additional components and sealing points at least in the case of attached individual stores.

The second variant has the advantage that it requires relatively little installation space in the region of the cylinder head and that no additional components and sealing points are required in this region. However, it has the disadvantage that in the collection line due to the common use of it as a reservoir for the injectors pronounced pressure oscillations are present, which is disadvantageous to the injection quality and which shortens the life span of various components of the injection system.

SUMMARY

The objective is therefore to provide a technical solution which does not have the aforementioned disadvantages of the state of the art or which at least partially avoids them.

This objective is solved by the subject-matter of the independent patent claims.

According to these, a first aspect of the invention relates to a high-pressure line for conveying a fluid under high pressure to a consumer, in particular for supplying diesel fuel under injection pressure to one or more injectors of a diesel engine.

The high-pressure line comprises a first, a second, and a third line section, which line sections are flowed through one after the other in the intended operation of the high-pressure line and which are jointly formed by a one-piece component made of metal. Thereby, the first line section and the third line section each have a smaller flow cross-section or line diameter, respectively, than the second line section arranged between these.

The high-pressure lines according to the invention make it possible to form common-rail injection systems which, even without injectors with integrated or attached individual stores and with a correspondingly small space requirement in the region of the cylinder head, provide each injector with its own store close to the injector from which it is supplied, so that pressure oscillations in the system can be largely prevented and a very good injection quality and life span can be achieved.

With advantage, the cross-section of the high-pressure line in the region of the second line section is at least two times as large, preferably at least three times as large as in the first line section and/or in the third line section.

It is also preferred that the volume of the second line section is at least five times as large as the volume of the first and the third line sections taken together, more preferably at least ten times as large.

It is also preferred that the line in the region of the second line section has a ratio of outer diameter to inner diameter of larger than 1.5, in particular of larger than 2.5.

Such cross-sectional, volume and diameter ratios have proven to be particularly practicable.

Preferably, the one-piece component of the line, from which the first, the second, and the third line sections of the high-pressure line are formed, consists of a metal material with a tensile strength larger than 900 MPa, even more preferably larger than 1100 MPa.

Particularly advantageous here are quenched and tempered steel, low-alloy steel, or austenitic stainless steel of type X5CrNi18-10 (AISI 304), X2CrNiMo17-12-2 (AISI 316), X15CrMnNiN17-7-5 (AISI 201), X15CrMnNiN18-8-5 (AISI 202), X19CrMnNiCuN17-8-3-3 (AISI 204), X2CrNiMnMoNbN21-9-4-3 or X4CrNiMnMo21-9-4.

If the one-piece component of the line, from which the first, the second, and the third line sections of the high-pressure line are formed, is free of joining elements, in particular free of welding seams, which is preferred, a particularly high pressure vibration strength of this component can be achieved.

In a preferred embodiment of the high-pressure line, the one-piece component of the line, from which the first, the second, and the third line sections of the high-pressure line are formed, is surrounded, at least in the region of the second line section, by one or more outer sheaths of an identical material or of a different material, preferably of another metal.

In this way, high-pressure lines according to the invention with improved functionalities can be provided, e.g., with an increased corrosion resistance in the interior of the line or with an increased pressure vibration resistance.

Thereby, according to a preferred variant, it is foreseen that between the one-piece component of the line, from which the first, the second, and the third line sections of the high-pressure line are formed, and an outer sheath a space surrounding the high-pressure line is formed for the controlled discharge of possible leakages. This can be easily created, for example, by first providing a profiling on the outer circumference of the one-piece component before coating it with the sheath.

It is thereby also preferred that the outer diameter of an outer sheath surrounding the one-piece component from which the first, the second, and the third line sections of the high-pressure line are formed, in the region of the second section of the line is more than two times, preferably more than three times, the inner diameter of the line. Such diameter ratios have proven to be particularly practicable.

In another preferred embodiment of the high-pressure line, a taper is present within the first line section, the second line section, and/or the third line section for dampening pressure oscillations in the line.

With advantage, the first line section and/or the third line section and/or a taper in the first, the second, or the third line section, if any, have been formed by means of rotary swaging or based on rotary swaging. By using this cold deformation, the deformed sections have an improved stability, which is desirable.

Thereby, it is particularly preferred that the one-piece component from which the first, the second, and the third line sections of the high-pressure line are formed, has been formed from a pipe material preferably produced by cold drawing or deep drilling with the cross-section of the second line section by means of rotary swaging or based on rotary swaging. Such components can be manufactured in a cost-effective manner and without joining elements.

In yet another preferred embodiment, the high-pressure line has exactly one feed opening and exactly one discharge opening.

Thereby, the first line section and the third line section are preferably arranged at the ends of the high-pressure line and are designed as connecting sections for pressure-tight connection of the high-pressure line to components supplying or discharging high-pressure fluid, with an advantage in such a way that they have pressure rings formed thereon or kneaded thereon.

Such lines are particularly suitable as supply lines for individual injectors leaving a common collection line or as modular bridge lines, which connect the injectors of directly subsequent cylinders of an engine with each other and thus together form a continuous fuel high-pressure line.

If the outer diameter of the high-pressure line in the region of the first line section and/or the third line section is smaller than in the region of the second line section, the additional advantage arises that less space is required in the region of the connection points.

In yet another preferred embodiment, the high-pressure line along its longitudinal extent comprises arranged one after another alternately line sections with smaller line cross-section or line diameter, respectively, and with larger line cross-section or line diameter, respectively, i.e. it comprises several storage regions connected to each other by tighter sections. In the case that the line sections with the larger line cross-section or line diameter, respectively, each have a radial discharge opening, such high-pressure lines according to the invention can be used as collection lines with a plurality of cascaded stores connected to one another via dampening sections, whereby each store is then assigned to an injector, which it supplies with fuel via a single supply line connected to its radial discharge opening. Thereby, the known problem of pressure oscillations in common-rail systems with a common collection line and individually diverging supply lines therefrom can be significantly reduced and thereby the injection quality and life span of various components of the injection system can be improved.

With an advantage, such a high-pressure line comprises a single axial feed opening. Thereby, the production can be simplified and the number of sealing points can be kept small.

In yet another preferred embodiment, the high-pressure line according to the invention is bent, in particular in the region of the second line section. Such lines have the advantage that they can be easily adapted to constructional conditions.

A second aspect of the invention relates to a method for manufacturing a high-pressure line according to the first aspect of the invention. Thereby, a metal pipe with a line cross section that is substantially uniform over the pipe length is reduced in its pipe cross section on at least two spaced apart from each other pipe sections by rotary swaging in the region of these sections.

With the method according to the invention high-pressure lines according to the invention can be manufactured in a cost-effective manner, which also have the advantage that they have an increased strength in the deformed regions.

In a preferred embodiment of the method, the rotary swaging is carried out at least in the region of the ends of the metal pipe. In this way, the pipe ends can also simultaneously constructed as connecting sections for pressure-tight connection of the high-pressure line produced in this way to components supplying and discharging high-pressure fluid, e.g., with pressure rings formed thereon or kneaded thereon, by means of which a form-locking engagement in axial direction at the respective line end with fastening means is possible.

In another preferred embodiment of the method, the rotary swaging is carried out in one or more pipe sections in such a way that the respective pipe cross-section is reduced beyond the desired cross-section reduction and is subsequently enlarged to the desired cross-section dimension, in particular by means of drilling.

In yet another preferred embodiment of the method, the rotary swaging is carried out in one or more pipe sections in such a way that the respective pipe cross-section is kneaded around an inner tool, in particular around a mandrel, until the material fits completely against the tool, and that the tool is then removed in such a way that the remaining pipe cross-section in this region substantially corresponds to the tool cross-section.

With the last two embodiments of the method according to the invention, precisely dimensioned line cross-sections can be achieved in the deformed regions.

A third aspect of the invention relates to a combustion engine, preferably a diesel or gas engine, with a high-pressure fuel pump permanently providing, in operation, fuel under injection pressure, which is connected via high-pressure lines to the injectors assigned to the single cylinders of the engine. Thereby, at least a part of the high-pressure lines is structured according to the first aspect of the invention.

The advantages of the invention are particularly evident when using the invention's high-pressure lines as high-pressure lines in the common rail injection system of a combustion engine.

In a first preferred embodiment of the engine, the fuel pump conveys into a high-pressure collection line, from which a single high-pressure feed line for each injector leads to the respective injector.

Thereby, it is preferred that the respective high-pressure feed line leading to the injector is constructed according to the first aspect of the invention and has exactly one feed opening and exactly one discharge opening, and it is further preferred that the first line section and the third line section are arranged at the ends of the high-pressure line and are formed as connecting sections for pressure-tight connection of the line to components supplying and discharging high-pressure fluid, preferably with pressure rings formed thereon or kneaded thereon. It is also preferred that the outer diameter of the high-pressure line in the region of the first line section and/or the third line section is smaller than in the region of the second line section.

Thereby, it is further preferred that the high-pressure collection line is constructed according to the first aspect of the invention and along its longitudinal extent arranged one after another alternately comprises line sections with a smaller line cross-section or line diameter, respectively, and with a larger line cross-section or line diameter, respectively, wherein the line sections with a larger line cross-section or line diameter, respectively each have a radial discharge opening to which the high-pressure feed line to the respective injector connects. Thereby, it is further preferred that the high-pressure collection line has a single axial feed opening.

In a second preferred embodiment of the engine, the injectors of cylinders of the engine directly following one another are each connected to one another via high-pressure bridge lines arranged between these, in particular of identical design, in such a way that the bridge lines together form a continuous high-pressure line. The high-pressure fuel pump thereby conveys into a high-pressure line leading to one of the injectors and from there into a bridge line leading away from this injector.

Thereby, it is preferred that the bridge lines each have exactly one feed opening and exactly one discharge opening, and it is further preferred that the first line section and the third line section are arranged at the ends of the respective high-pressure line and are constructed as connecting sections for pressure-tight connection of the line to components supplying and discharging high-pressure fluid, preferably with pressure rings formed thereon or kneaded thereon. It is also preferred thereby that the outer diameter of the bridge lines in the region of the first line section and/or the third line section is smaller than in the region of the second line section.

With such combustion engines, excellent emission values and long life spans of the injection components can be achieved.

BRIEF DESCRIPTION OF THE DRAWINGS

Further preferred embodiments of the invention result from the dependent claims as well as from the now following description on the basis of the figures. Thereby show:

FIG. 3*a* shows a section along line A-A in FIG. 3

DESCRIPTION OF THE PREFERRED EMBODIMENTS

Figure 1:
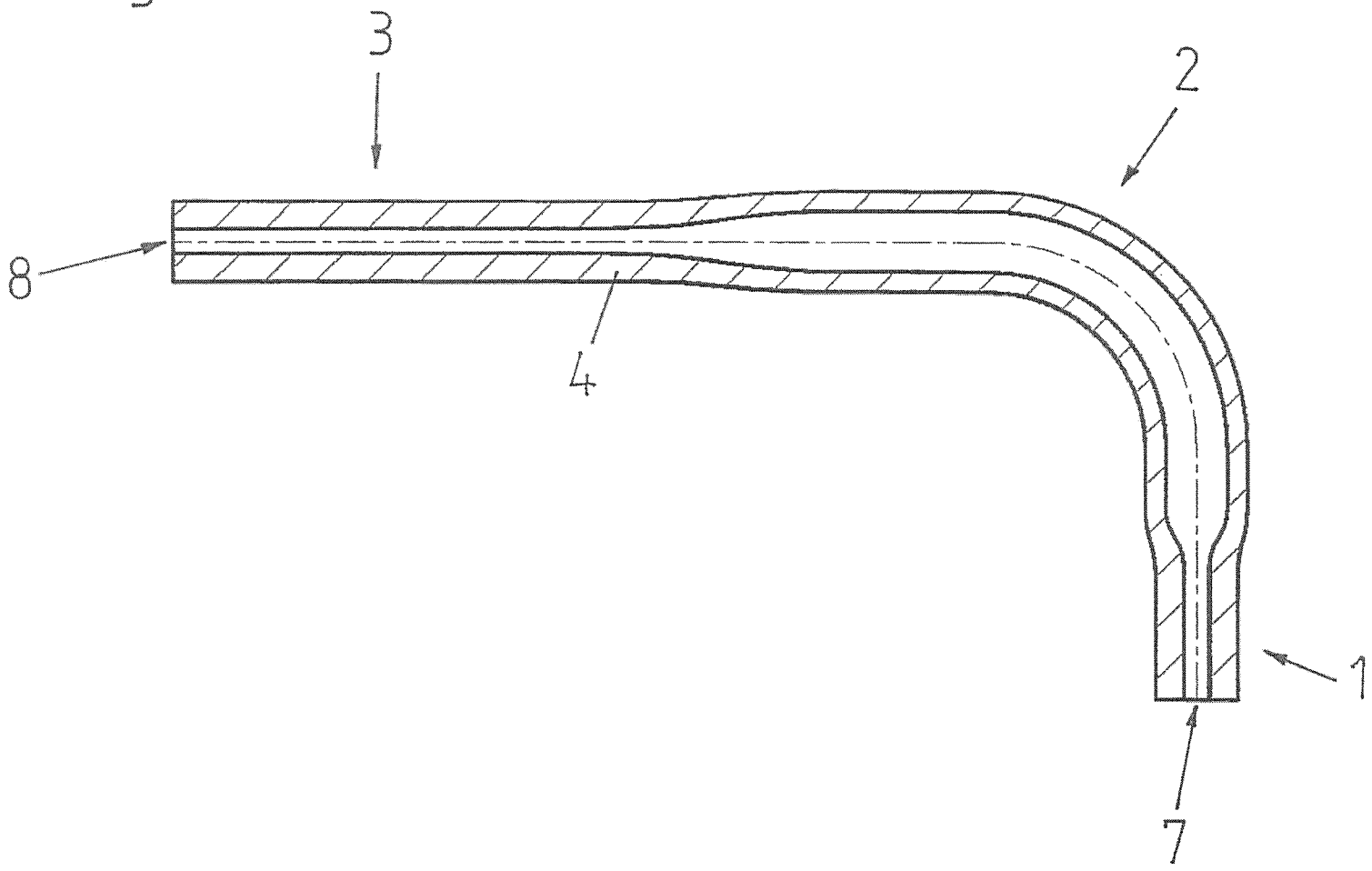
FIG. 1 shows a longitudinal section through a first high-pressure feed line according to the invention.

FIG. 1 shows a longitudinal section through a first high-pressure injector feed line according to the invention of a common rail injection system of a diesel engine for connecting the injector to a high-pressure collection line of the injection system.

As can be seen, the high-pressure injector feed line has three line sections 1, 2, 3, which are, in the intended operation, flowed through one after the other by the diesel fuel which enters the line at the feed opening 7 and flows off to the injector via the discharge opening 8, and which are jointly formed by a one-piece pipe body 4 made of a low-alloy quenched and tempered steel of type 42CrMo4. The pipe body 4 is free of joining elements.

The first line section 1 and the third line section 3, which are formed at the ends of the high-pressure injector feed line and which are designed as straight pipe sections, each have a smaller line diameter than the second line section 2 arranged between them, which is designed as a 90° pipe elbow. The line diameter in the second line section 2 corresponds approximately to 2.5 times of the line diameter in the first 1 or third line section 3, respectively.

The second line section 2 is approximately the same length as the first 1 and the third line section 3 taken together, and its volume is more than five times as large as the volume of the first 1 and the third line section 3 taken together.

The first line section 1 and the third line section 3 have been formed by rotary swaging, and before rotary swaging had a cross-section identical to that of the second line section 2. Accordingly, the outer diameter of the high-pressure line in the region of the first line section 1 and the third line section 3 is smaller than in the region of the second line section 2, and the ratio of outer diameter to inner diameter in the region of the second line section 2 is approximately 1.6, whereas in the region of the first line section 1 and the third line section 3 it is approximately 3.4.

Figure 2:
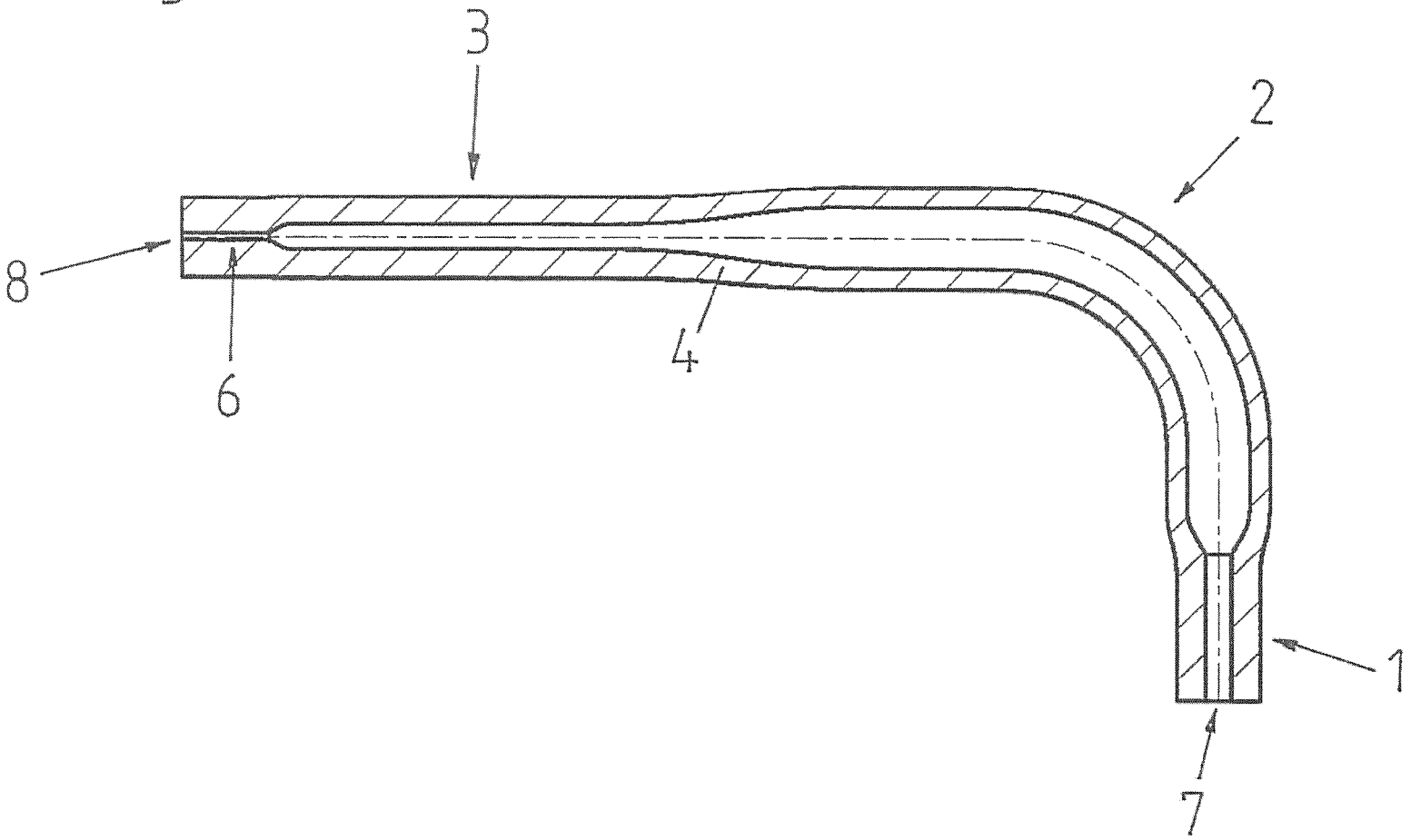
FIG. 2 shows a longitudinal section through a second high-pressure feed line according to the invention.

FIG. 2 shows a longitudinal section through a second high-pressure injector feed line according to the invention of a common rail injection system, which differs from the one shown in FIG. 1 only in that the third line section 3 has a taper 6 in the region of the discharge opening 8, for dampening of pressure oscillations in the line.

Figure 3:
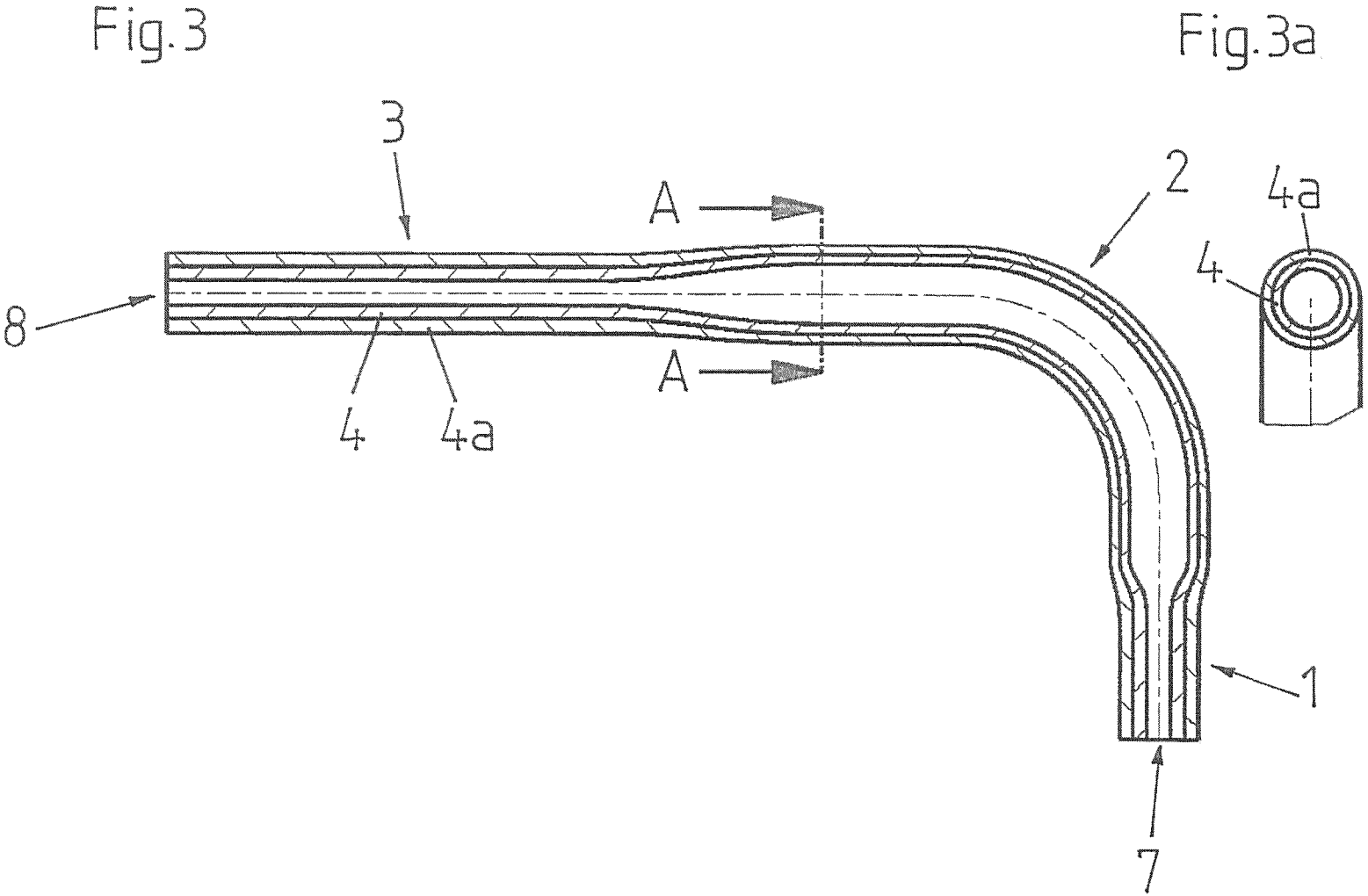
FIG. 3 shows a longitudinal section through a third high-pressure feed line according to the invention.

FIG. 3 shows a longitudinal section through a third high-pressure injector feed line according to the invention of a common rail injection system, and FIG. 3*a* shows a cross-section through the line along line A-A in FIG. 3. This high-pressure injector feed line differs from the one shown in FIG. 1 in that the one-piece component 4 forming the three line sections 1, 2, 3 has thinner walls and is made of tempered steel and is surrounded over its entire extent by an outer sheath 4*a* of austenitic stainless steel free of gaps. The thus resulting total wall thicknesses in the individual line sections 1, 2, 3 are approximately comparable to those of the high-pressure injector feed line from FIG. 1. Here, too, the first line section 1 and the third line section 3 have been formed by rotary swaging. Before rotary swaging, they had a cross-section identical to that of the second line section 2.

Figure 4:
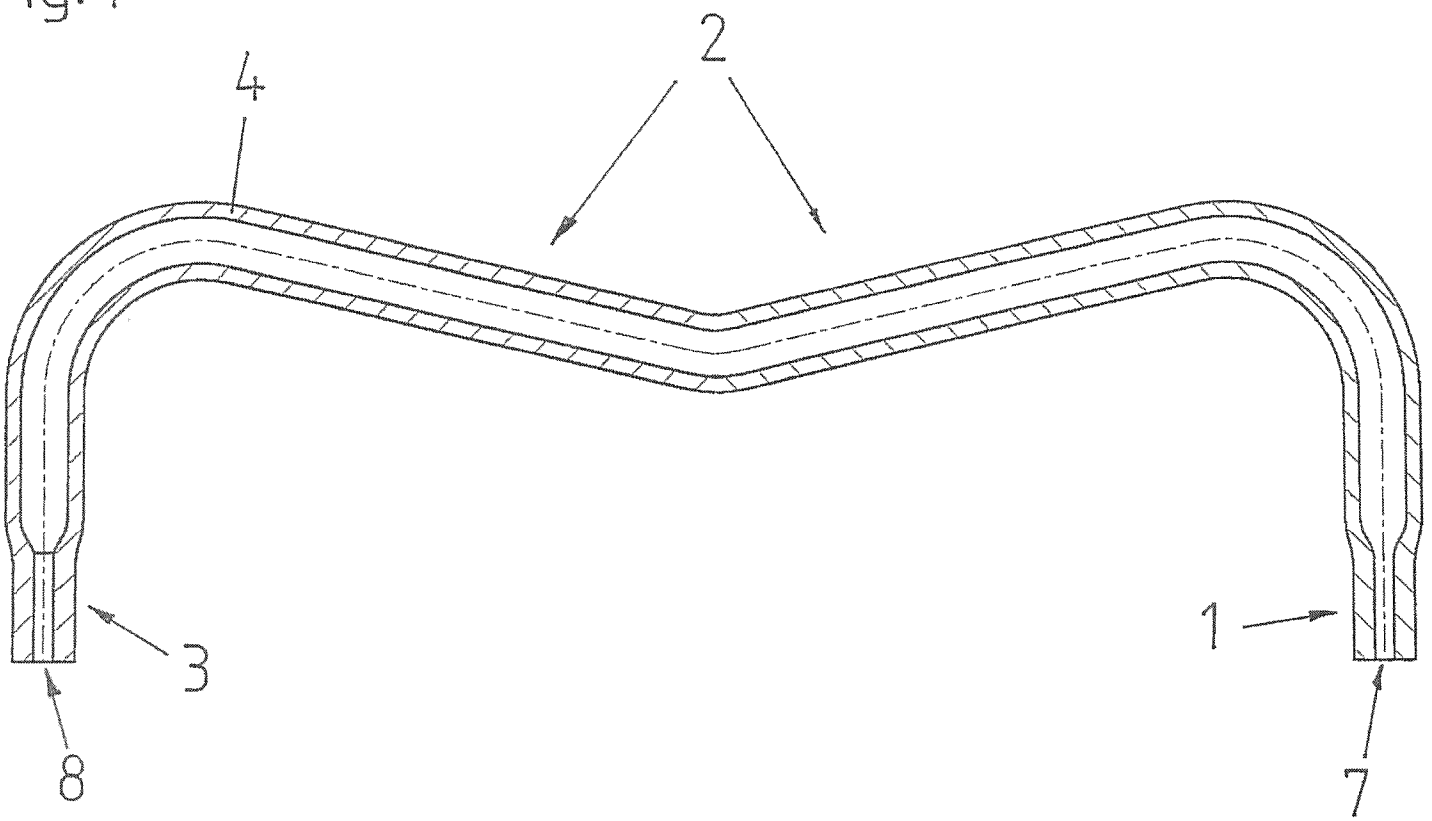
FIG. 4 shows a longitudinal section through a first high-pressure bridge line according to the invention.

FIG. 4 shows a longitudinal section through a first high-pressure bridge line (also called jumper line) according to the invention of a common rail injection system of a diesel engine for connecting two injectors of the engine.

This high-pressure bridge line differs from the high-pressure injector feed line shown in FIG. 1 only in that it has a mirror-inverted shape in which the first and third line sections 1, 3 at the ends are formed identical and are oriented in the same direction and are connected to one another via a bow-shaped central second line section 2. Thereby, the second line section 2 is considerably longer than in the high-pressure injector feed line shown in FIG. 1, whereby its volume is correspondingly larger. Other than that, everything said above for the high-pressure injector feed line shown in FIG. 1 applies also to this high-pressure bridge line.

Figure 5:
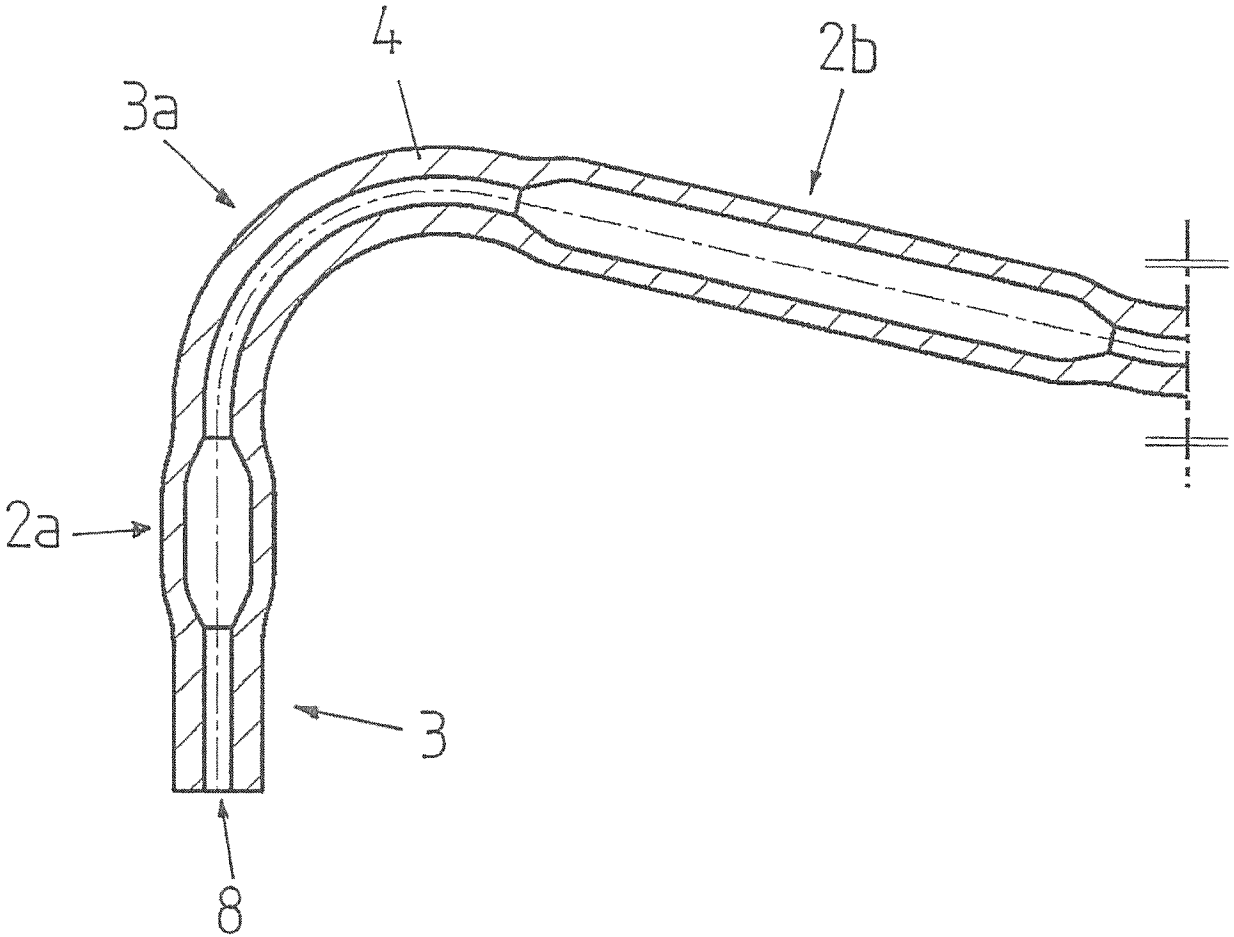
FIG. 5 shows a longitudinal section through one half of a second high-pressure bridge line according to the invention.

FIG. 5 shows a longitudinal section through one half of a second high-pressure bridge line according to the invention, which has the same mirror-inverted basic shape as the high-pressure bridge line shown in FIG. 4. The bridge line shown here differs from the line shown in FIG. 4 only in that, along its longitudinal extent, it comprises alternately arranged one after another line section with smaller line diameter 3, 3*a* and line sections with larger line diameter 2*a*, 2*b*, namely a total of five line sections with smaller line diameter (only two (3, 3*a*) and a part of a third are visible because of the representation of only one half of the line) and a total of four line sections with larger line diameter (only two (2*a*, 2*b*) are visible because of the representation of only one half of the line). The line sections 1, 3 at the ends (only the left line section 1 is visible due to the representation of only one half of the line) are identical to the ones shown in FIG. 4 at the high-pressure bridge line.

Figure 6:
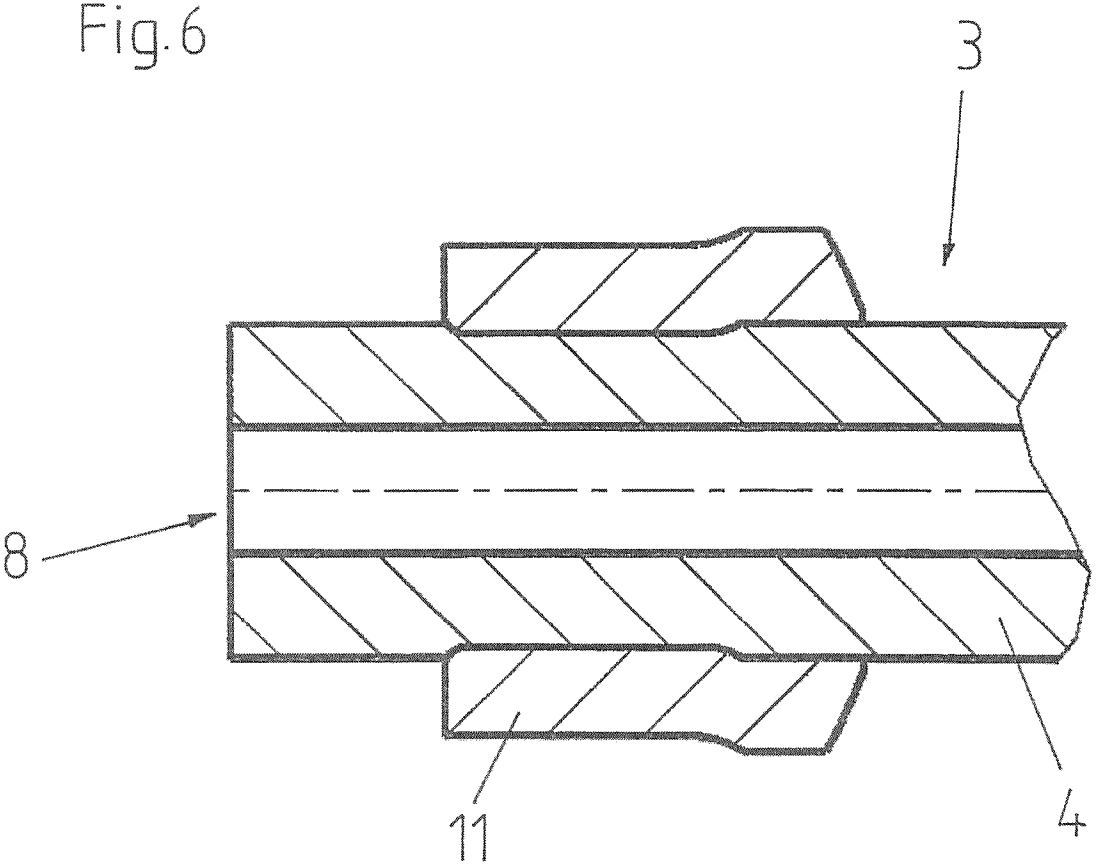
FIG. 6 shows a longitudinal section through a connection end of a high-pressure line according to the invention with a pressure ring kneaded thereon.

FIG. 6 shows a longitudinal section through a connecting section 3 at the end with a discharge opening 8 of a high-pressure line according to the invention as shown in the preceding figures with a pressure ring 11 kneaded thereon.

Figure 7:
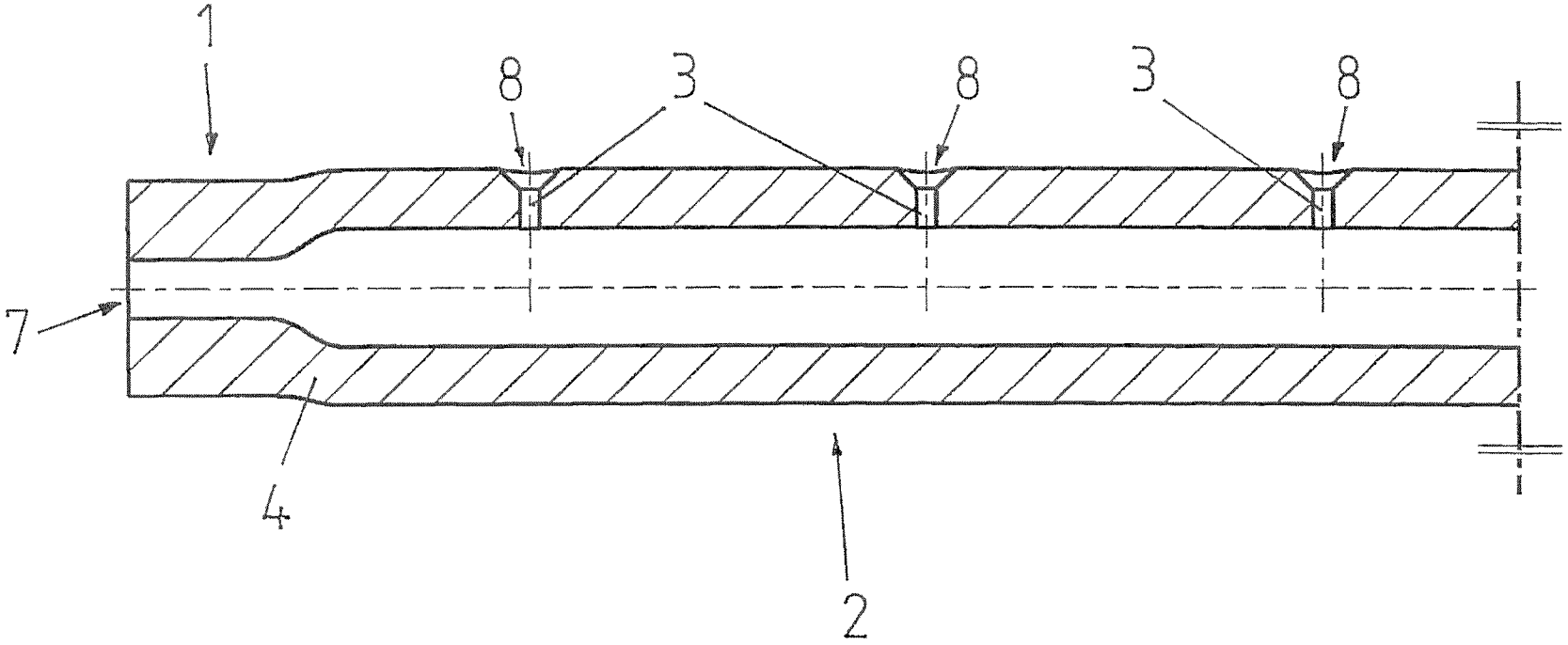
FIG. 7 shows a longitudinal section through a section of a first high-pressure collection line according to the invention.

FIG. 7 shows a longitudinal section through a part of a first high-pressure collection line according to the invention of a common rail injection system of a diesel engine, with which several high-pressure feed lines for the injectors of the injection system are supplied.

As can be seen, the high-pressure collection line comprises a feed line section 1 with a feed opening 7, a distribution section 2 and, leading away from the distribution section 2, several discharge channels 3, each forming a discharge opening 8 of the collection line, for supplying the feed lines for the injectors to be connected thereto.

The feed line section 1, the distribution line section 2, and the discharge channels 3 are, in the intended operation, flowed through one after the other by the diesel fuel entering the collection line at the supply opening 7 and flowing out via the discharge openings 8 to the feed lines for the injectors and they are jointly formed by a one-piece pipe body 4 of a quenched and tempered low-alloy steel with a tensile strength larger than 900 MPa.

The feed line section 1 and the distribution section 2 are formed as straight pipe sections arranged one behind the other with coinciding center axes, while the discharge channels 3 branch off radially from the distribution section 2.

The feed line section 1 has a smaller line diameter than the distribution section 2, and the discharge channels 3 have smaller line diameters than the feed line section 1. The line diameter of the distribution section 2 is approximately two times the line diameter of the feed line section 1, whose line diameter is in turn approximately three times the line diameter of the discharge channels 3.

The feed line section 1 has been formed by rotary swaging, and had a cross-section identical to that of the distribution section 2 before rotary swaging. Accordingly, the outer diameter of the collection line in the region of the first feed line section 1 is smaller than in the region of the second distribution section 2. The ratio of outer diameter to inner diameter is approximately 2.0 in the region of the distribution section 2, while it is approximately 3.6 in the region of the feed line section 1.

The discharge channels 3 with the discharge openings 8 have been introduced into the wall of the distribution section 2 by means of drilling.

Figure 8:
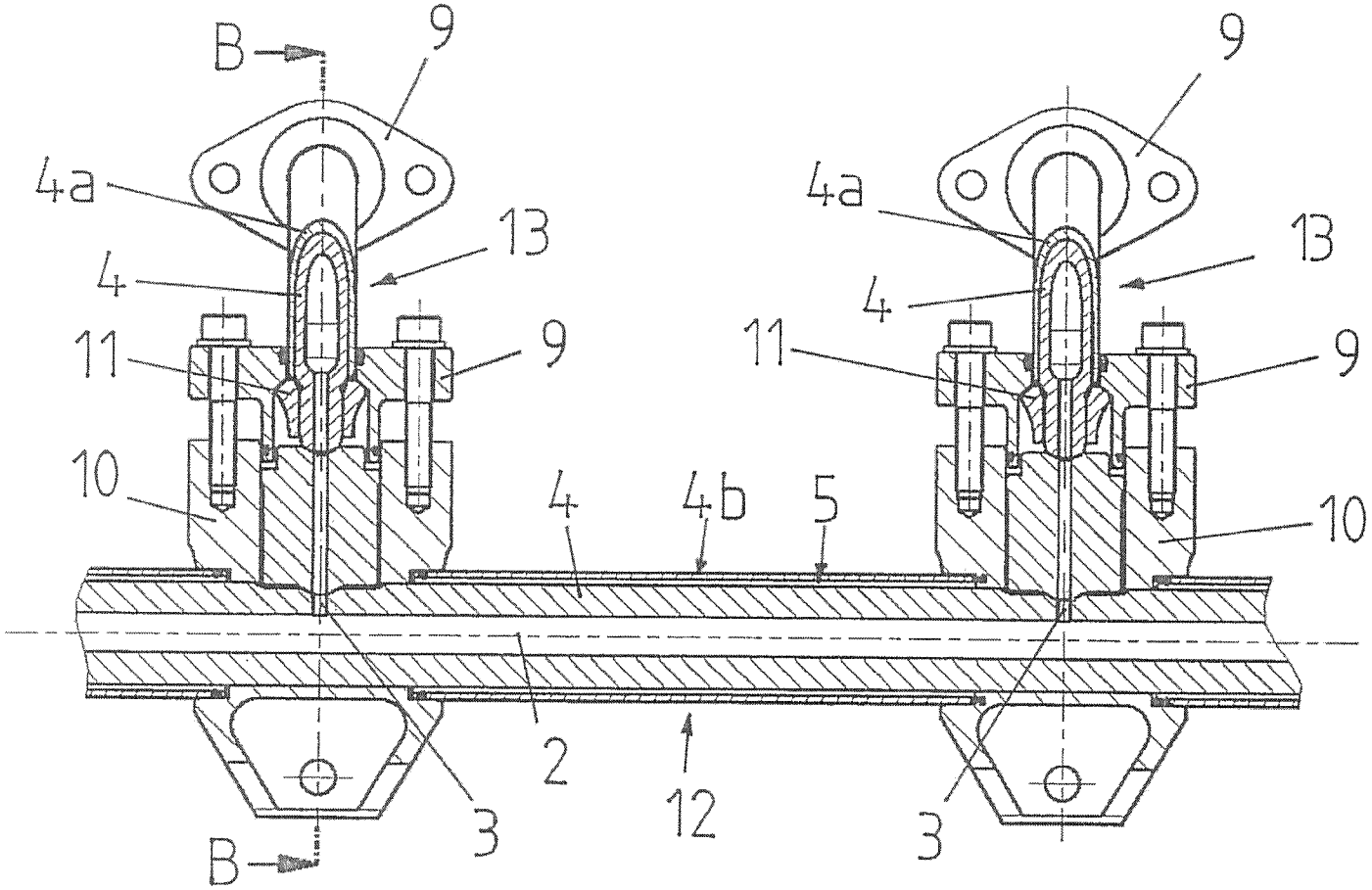
FIG. 8 shows a longitudinal section through a section of a second high-pressure collection line according to the invention with connected high-pressure feed lines according to the invention.
Figure 8A:
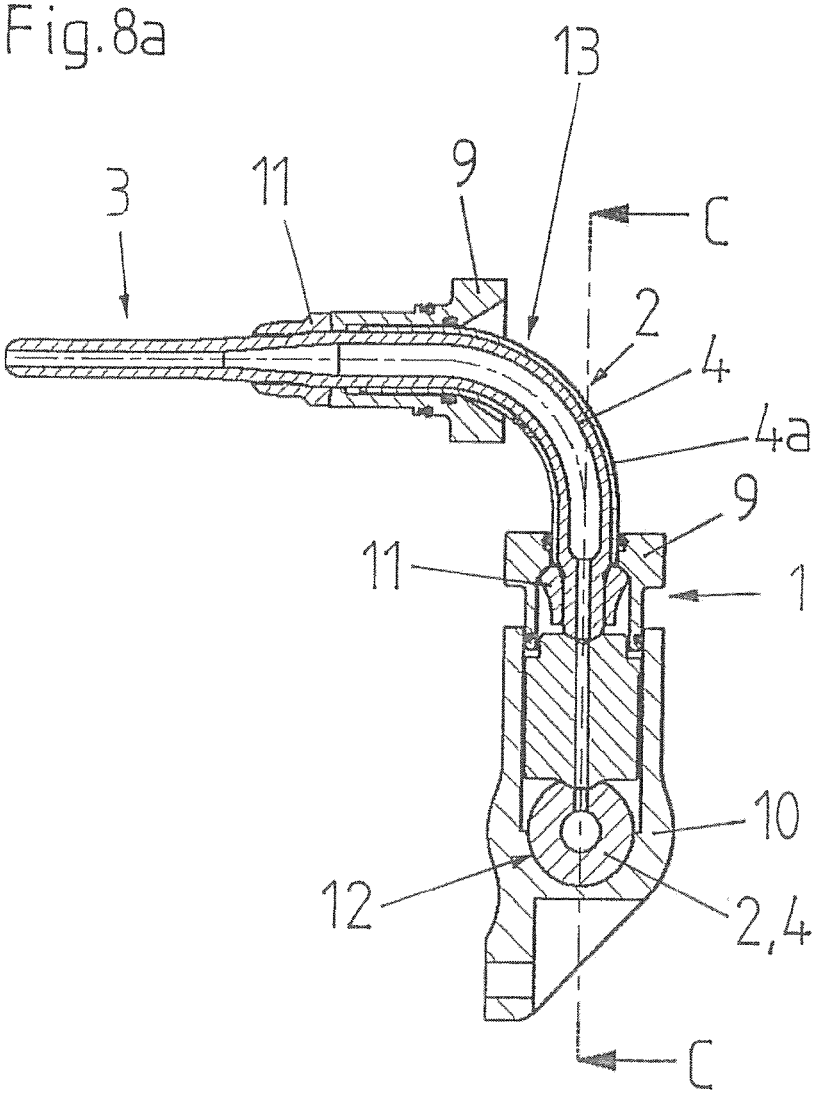
FIG. 8*a* shows a section along the line B-B in FIG. 8.

FIG. 8 shows a longitudinal section through a section of a second high-pressure collection line 12 according to the invention with connected high-pressure feed lines 13 according to the invention and FIG. 8*a* shows a section along line B-B in FIG. 8. The sectioning of FIG. 8 follows line C-C in FIG. 8*a*.

The high-pressure collection line 12 shown here differs from the collection line shown in FIG. 7 in that the one-piece pipe body 4, which forms the (not shown) feed line section, the distribution section 2 and the discharge channels 3 with the discharge openings, is surrounded in the regions between the connections 9, 10 of the high-pressure feed lines 13 by an outer sheath 4*b* made of metal, which together with the pipe body 4 forms a space 5 which surrounds the pipe body 4 for the controlled removal of possible leakage.

The high-pressure feed lines 13 shown here differ from the feed line shown in FIG. 3 in that the sheath 4*a* at the connection ends of the lines 13 is missing and instead a kneaded pressure ring 11 is provided, which serves to fasten the respective line end by means of a compression flange 9 to a fastening body 10 encompassing the high-pressure collection line 12.

Figure 9:
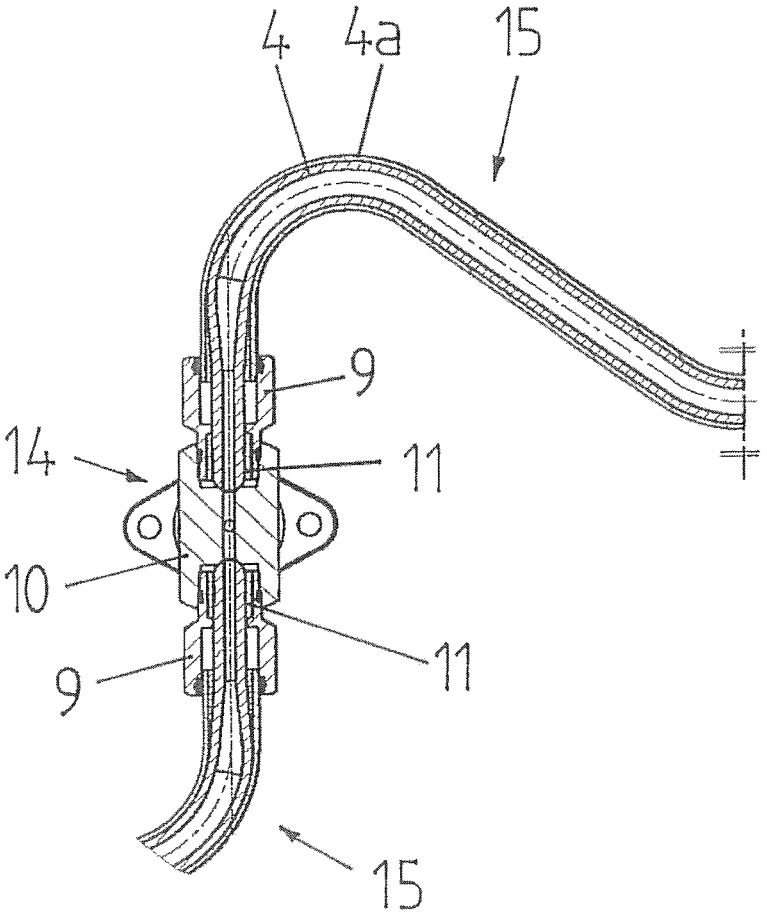
FIG. 9 shows a section through two high-pressure bridge lines according to the invention connected to an injector.

FIG. 9 shows a section through two high-pressure bridge lines 15 (each only partially shown) according to the invention connected to an injector 14.

The high-pressure bridge lines 15 shown here differ from the bridge line shown in FIG. 4 in that, except for the connection ends, they are provided with a sheath 4*a* and at each connection end there is a kneaded pressure ring 11 which serves to fasten the respective line end by means of a coupling nut 9 to a connection block 10 of the injector 14.

Figure 10:
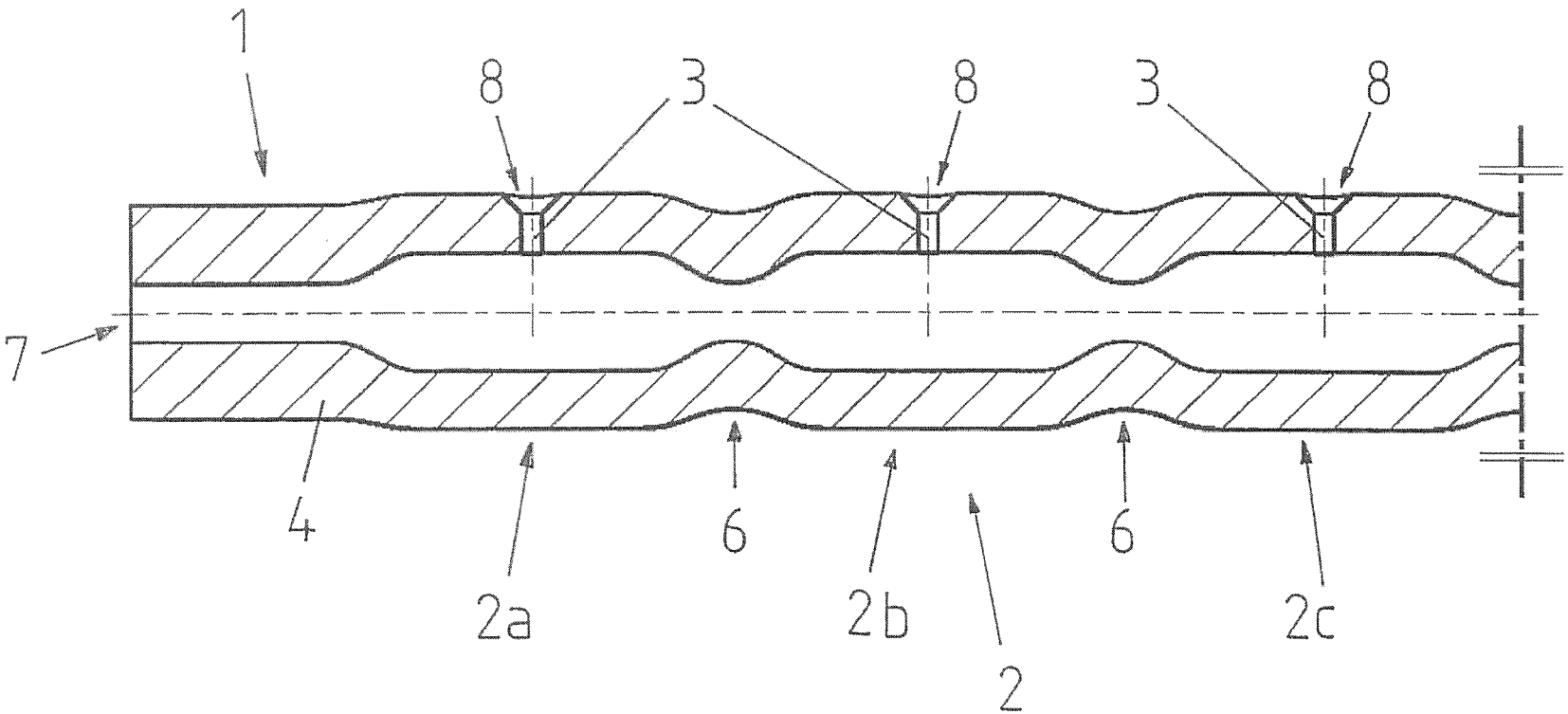
FIG. 10 shows a longitudinal section through part of a section of a third high-pressure collection line according to the invention.

FIG. 10 shows a longitudinal section through a part of a third high-pressure collection line according to the invention of a common rail injection system of a diesel engine, with which several high-pressure feed lines for the injectors of the injection system are supplied.

This high-pressure collection line differs from the collection line shown in FIG. 7 only in that the one-piece pipe body 4 which forms the feed line section 1, the distribution section 2, and the discharge channels 3 with the discharge openings 8, in the region of the distribution section 2 along its longitudinal extent comprises alternately arranged one after another line sections 6 with a smaller line diameter and line sections 2*a*, 2*b*, 2*c* with a larger line diameter. In this way, the storage section 2 forms several storage regions connected to each other by narrower sections, from each of which a radial discharge channel 3 with discharge opening 8 branches off. Accordingly, in the intended use of this high-pressure collection line, each of these storage regions 2*a*, 2*b*, 2*c* is assigned exactly to one injector, which it supplies with fuel via a single feed line connected to its radial discharge opening 8.

The tapered line sections 6 with the smaller line diameter have been produced by rotary swaging.

While in the present application preferred embodiments of the invention are described, it is to be clearly pointed out that the invention is not limited thereto and that it can also be carried out in another way within the scope of the following patent claims.

What is claimed is:

1. A combustion engine, in particular diesel or gas engine, with a high-pressure fuel pump permanently providing, in operation, fuel under injection pressure which is connected via high-pressure lines to the injectors assigned to the single cylinders of the engine, wherein the injectors of cylinders of the engine directly following one another are each connected to one another via high-pressure bridge lines arranged between these, in particular of identical design, in such a way that the bridge lines together form a continuous high-pressure line, and wherein the high-pressure fuel pump conveys fuel into a high-pressure line which leads to one of the injectors and from there feeds fuel into a bridge line leading away from the one of the injectors to the other of the injectors, wherein the bridge lines have exactly one feed opening and exactly one discharge opening, and wherein the bridge lines comprise a first, a second, and a third line section, which line sections are flowed through successively in the intended operation of the engine and are jointly formed by a one-piece metal component, wherein the first line section and the third line section each have a smaller flow cross-section, in particular a smaller line diameter than the second line section arranged between them.

2. The combustion engine according to claim 1, wherein the first (1) and the third line section (3) of the bridge lines (15) are arranged at the ends of the bridge lines and are constructed as connecting sections for pressure-tight connection of the bridge line to components (9, 10) supplying and discharging fuel, in particular with pressure rings (11) formed thereon or kneaded thereon.

3. The combustion engine according to claim 1, wherein the outer diameter of the bridge lines (15) in the region of the first line section (1) and/or of the third line section (3) is smaller than in the region of the second line section (2).

4. The combustion engine according to claim 1, wherein the line cross-section of the bridge lines (15) in the region of the second line section (2) is at least two times as large, in particular at least three times as large, as in the first line section (1) and/or in the third line section (3).

5. The combustion engine according to claim 1, wherein the volume of the second line section (2) of the bridge lines (15) is at least five times, in particular at least ten times, as large as the volume of the first (1) and the third line section (3) taken together.

6. The combustion engine according to claim 1, wherein the bridge lines (15) in the region of the second line section (2) have a ratio of outer diameter to inner diameter of larger than 1.5, in particular of larger than 2.5.

7. The combustion engine according to claim 1, wherein at the bridge lines (15) the one-piece component (4) is formed from a material with a tensile strength larger than 900 MPa, in particular larger than 1100 MPa.

8. The combustion engine according to claim 1, wherein at the bridge lines (15) the one-piece component (4) which forms the first (1), the second (2), and the third line section (3), is formed from a metal selected from the group consisting of quenched and tempered steel, a low-alloy steel, and an austenitic stainless steel of type X5CrNi18-10 (AISI 304), X2CrNiMo17-12-2 (AISI 316), X15CrMnNiN17-7-5 (AISI 201), X15CrMnNiN18-8-5 (AISI 202), X19CrMnNiCuN17-8-3-3 (AISI 204), X2CrNiMnMoNbN21-9-4-3, and X4CrNiMnMo21-9-4.

9. The combustion engine according to claim 1, wherein at the bridge lines (15) the one-piece component (4) which forms the first (1), the second (2), and the third line section (3) is free of joining elements, in particular free of welding seams.

10. The combustion engine according to claim 1, wherein at the bridge lines (15) the one-piece component (4) which forms the first (1), the second (2), and the third line section (3) is surrounded, at least in the region of the second line section (2), by one or more outer sheaths (4*a*, 4*b*) of an identical material or of a different material, in particular of another metal.

11. The combustion engine according to claim 10, wherein an outer sheath (4*b*) is provided which, together with the one-piece component (4) which forms the first (1), the second (2), and the third line section (3), forms a space (5) surrounding this one-piece component (4) for the controlled removal of possible leakage.

12. The combustion engine according to claim 10, wherein at the bridge lines (15) the outer diameter of an outer sheath (4*a*, 4*b*) surrounding the one-piece component (4) which forms the first (1), the second (2), and the third line section (3) of the high-pressure line, in the region of the second line section (2) is more than two times, in particular more than three times, the inner diameter of the line.

13. The combustion engine according to claim 1, wherein at the bridge lines (15) a taper (6) of the line cross-section is present within the first (1), the second (2), and/or the third line section (3) for dampening pressure oscillations in the line.

14. The combustion engine according to claim 1, wherein at the bridge lines (15) the first (1) and/or the third line section (3) and/or a taper (6) in the first, the second, or the third line section, if any, has been formed by means of rotary swaging or based on rotary swaging.

15. The combustion engine according to claim 14, wherein at the bridge lines (15) the one-piece component (4) which forms the first (1), the second (2), and the third line section (3), has been formed from a pipe material, in particular produced by cold drawing or deep drilling, with the cross-section of the second line section by means of rotary swaging or based on rotary swaging.

16. The combustion engine according to claim 1, wherein the bridge lines (15) along their longitudinal extent, arranged one after another alternately comprise line sections (1, 3, 3*a*) with a smaller line cross-section or line diameter, respectively, and line sections (2*a*, 2*b*) with a larger line cross-section or line diameter, respectively.

17. The combustion engine according to claim 16, wherein the bridge lines have a single axial feed opening (7).

18. The combustion engine according to claim 1, wherein the bridge lines (15) are bent, in particular in the region of the second line section (2).

19. A bridge line for a combustion engine according to claim 1, comprising a first (1), a second (2), and a third line section (3), which line sections (1, 2, 3) are flowed through successively in the intended operation of the bridge line and are jointly formed by a one-piece component (4) of metal, wherein the first line section (1) and the third line section (3) each have a smaller flow cross-section, in particular a smaller line diameter, than the second line section (2) arranged between them, wherein the bridge line has exactly one feed opening (7) and exactly one discharge opening (8), and wherein the first (1) and the third (3) line sections are arranged at the ends of the bridge line and are constructed as connecting sections for pressure-tight connection of the bridge line to components (9, 10) supplying and discharging fuel, with pressure rings (11) kneaded thereon.

20. The bridge line according to claim 19, wherein the line cross-section of the line in the region of the second line section (2) is at least two times as large, in particular at least three times as large, as in the first (1) and/or in the third line section (3).

21. The bridge line according to claim 19, wherein the volume of the second line section (2) is at least five times, in particular at least ten times, as large as the volume of the first (1) and the third line section (3) taken together.

22. The bridge line according to claim 19, wherein the line in the region of the second line section (2) has a ratio of outer diameter to inner diameter of larger than 1.5, in particular of larger than 2.5.

23. The bridge line according to claim 19, wherein the one-piece component (4) of the line is formed from a material with a tensile strength larger than 900 MPa, in particular larger than 1100 MPa.

24. The bridge line according to claim 19, wherein the one-piece component (4) which forms the first (1), the second (2), and the third line section (3) of the bridge line is made of a metal selected from the group of quenched and tempered steel, a low alloy steel, and an austenitic stainless steel of type X5CrNi18-10 (AISI 304), X2CrNiMo17-12-2 (AISI 316), X15CrMnNiN17-7-5 (AISI 201), X15CrMnNiN18-8-5 (AISI 202), X19CrMnNiCuN17-8-3-3 (AISI 204), X2CrNiMnMoNbN21-9-4-3, and X4CrNiMnMo21-9-4.

25. The bridge line according to claim 19, wherein the one-piece component (4) which forms the first (1), the second (2), and the third line section (3) of the bridge line, is free of joining elements, in particular free of welding seams.

26. The bridge line according to claim 19, wherein the one-piece component (4) which forms the first (1), the second (2), and the third line section (3) of the bridge line, is surrounded, at least in the region of the second line section (2), by one or more outer sheaths (4*a*, 4*b*) of an identical material or of a different material, in particular of another metal.

27. The bridge line according to claim 26, wherein an outer sheath (4*b*) is provided which, together with the one-piece component (4) which forms the first (1), the second (2), and the third line section (3) of the bridge line, forms a space (5) surrounding this one-piece component (4) for the controlled removal of possible leakage.

28. The bridge line according to claim 26, wherein the outer diameter of an outer sheath (4*a*, 4*b*) surrounding the one-piece component (4) which forms the first (1), the second (2), and the third line section (3) of the bridge line, in the region of the second line section (2) is more than two times, in particular more than three times, the inner diameter of the line.

29. The bridge line according to claim 19, wherein a taper (6) of the line cross-section is present within the first (1), the second (2), and/or the third line section (3), for dampening pressure oscillations in the line.

30. The bridge line according to claim 19, wherein the first (1) and/or the third line section (3) and/or any taper (6) in the first, the second, or the third line section, if any, has been formed by means of rotary swaging or based on rotary swaging.

31. The bridge line according to claim 30, wherein the one-piece component (4) which forms the first (1), the second (2), and the third line section (3) of the bridge line has been formed from a pipe material, in particular produced by cold drawing or deep drilling, with the cross-section of the second line section by means of rotary swaging or based on rotary swaging.

32. The bridge line according to claim 19, wherein the outer diameter of the bridge line in the region of the first (1) and/or the third line section (3) is smaller than in the region of the second line section (2).

33. The bridge line according to claim 19, wherein the bridge line along its longitudinal extent, arranged one after another alternately comprises line sections (1, 3, 3*a*) with a smaller line cross-section or line diameter, respectively, and line sections (2*a*, 2*b*) with a larger line cross-section or line diameter, respectively, and in particular wherein the line sections with larger line cross-section or line diameter, respectively, each comprise a radial discharge opening.

34. The bridge line according to claim 33, wherein the line has a single axial feed opening (7).

35. The bridge line according to claim 19, wherein the bridge line is bent, in particular in the region of the second line section (2).

36. A method for manufacturing a bridge line according to claim 19 comprising the steps of:

a) providing a metal pipe with a substantially uniform pipe cross-section over the length of the pipe; and b) rotary swaging of the metal pipe on at least two spaced apart pipe sections for reducing the pipe cross-section in the region of these sections.

37. The method according to claim 36, wherein the rotary swaging is carried out in the region of the ends of the metal pipe.

38. The method according to claim 37, wherein a pressure ring is formed or kneaded onto the respective end of the metal pipe by means of the rotary swaging, by means of which a form-locking engagement in an axial direction is possible at the respective pipe end with fastening means for the purpose of connecting the pipe to a component.

39. The method according to claim 36, wherein the rotary swaging is carried out on several pipe sections, in particular uniformly spaced apart from one another, in the region between the ends of the metal pipe.

40. The method according to claim 36, wherein the rotary swaging is carried out at least in one pipe section in such a way that the pipe cross-section is reduced beyond the desired cross-section reduction and is subsequently enlarged to the desired cross-section dimension, in particular by means of drilling.

41. The method according to claim 36, wherein the rotary swaging is carried out at least in one pipe section in such a way that the pipe cross-section is kneaded around an inner tool, in particular around a mandrel, until the material fits completely against the tool, and the tool is subsequently removed in such a way that the remaining pipe cross-section in this region substantially corresponds to the tool cross-section.

* * * * *